US011072969B2

(12) United States Patent
Kendall et al.

(10) Patent No.: US 11,072,969 B2
(45) Date of Patent: Jul. 27, 2021

(54) DOOR SILL SYSTEM, APPARATUS AND METHODS FOR A DOOR ASSEMBLY

(71) Applicant: Endura Products, Inc., Greensboro, NC (US)

(72) Inventors: Adam Kendall, Burlington, NC (US); Tomasz Jaskiewicz, Oak Ridge, NC (US)

(73) Assignee: Endura Products, LLC, Colfax, NC (US)

( * ) Notice: Subject to any disclaimer, the term of this patent is extended or adjusted under 35 U.S.C. 154(b) by 58 days.

(21) Appl. No.: 16/562,563

(22) Filed: Sep. 6, 2019

(65) Prior Publication Data

US 2020/0080361 A1 Mar. 12, 2020

Related U.S. Application Data

(60) Provisional application No. 62/729,725, filed on Sep. 11, 2018.

(51) Int. Cl.
*E06B 1/70* (2006.01)

(52) U.S. Cl.
CPC ..... *E06B 1/70* (2013.01)

(58) Field of Classification Search
CPC ..... E06B 1/70
USPC ..... 49/467
See application file for complete search history.

(56) References Cited

U.S. PATENT DOCUMENTS

| | | | | |
|---|---|---|---|---|
| 344,963 | A | 7/1886 | Hayes | |
| 1,207,827 | A | 12/1916 | Winters | |
| 1,729,243 | A | 9/1929 | Bricker | |
| 1,910,260 | A | 5/1933 | Reher | |
| 2,188,049 | A | 1/1940 | Kammerer | 20/64 |
| 2,722,724 | A | 11/1955 | Miller | 20/64 |
| 2,788,551 | A | 4/1957 | Hildreth | 20/64 |
| 2,848,766 | A | 8/1958 | Fulton | 20/64 |
| 2,875,481 | A | 3/1959 | Erkkila | 20/64 |
| 3,032,839 | A | 5/1962 | Miller | 20/64 |
| 3,079,652 | A | 3/1963 | Wahlfeld | 20/64 |
| 3,382,617 | A | 5/1968 | St. Aubin | 49/468 |
| 3,521,404 | A * | 7/1970 | Hager | E06B 1/70 49/468 |
| 3,667,164 | A | 6/1972 | Coppins | 49/469 |
| 4,476,653 | A | 10/1984 | Speer et al. | 49/468 |
| 4,831,779 | A | 5/1989 | Kehrli et al. | 49/471 |
| 5,010,690 | A | 4/1991 | Geoffrey | 49/468 |
| 5,067,279 | A | 11/1991 | Hagemeyer | 49/471 |
| 5,136,814 | A | 8/1992 | Headrick | 49/468 |
| 5,179,804 | A | 1/1993 | Young | 49/471 |
| 5,426,894 | A | 6/1995 | Headrick | 49/468 |

(Continued)

FOREIGN PATENT DOCUMENTS

| | | | | |
|---|---|---|---|---|
| CA | 2264357 A1 * | 9/2000 | | E06B 1/70 |
| CA | 2771705 A1 * | 2/2013 | | E06B 1/70 |

(Continued)

*Primary Examiner* — Jerry E Redman
(74) *Attorney, Agent, or Firm* — MacCord Mason PLLC

(57) ABSTRACT

A system, device, kit, assembly and methods for a frame assembly, including a door sill as shown and described. The assembly may be a door frame assembly and may, by way of example, be a door jamb and/or a door mullion including a door sill. Some inventions of the present disclosure may be considered a door sill having a deck.

20 Claims, 4 Drawing Sheets

(56) References Cited

U.S. PATENT DOCUMENTS

| | | | | |
|---|---|---|---|---|
| 5,553,419 | A * | 9/1996 | Jenkins, II | E06B 1/70 49/469 |
| 5,588,266 | A | 12/1996 | Headrick | 52/204.1 |
| 5,611,173 | A | 3/1997 | Headrick et al. | 49/468 |
| 6,125,599 | A | 10/2000 | Mees et al. | 52/204.5 |
| 6,216,395 | B1 | 4/2001 | Kelly | 49/467 |
| 6,269,591 | B1 | 8/2001 | Kelly | 49/482.1 |
| 6,289,635 | B1 | 9/2001 | Procton et al. | |
| 6,345,477 | B1 | 2/2002 | Kepler et al. | 52/204.1 |
| 6,371,188 | B1 | 4/2002 | Baczuk et al. | 160/92 |
| 6,484,446 | B2 | 11/2002 | Young | 49/469 |
| 7,266,929 | B1 * | 9/2007 | Allred | E06B 1/70 49/467 |
| 7,389,611 | B2 | 6/2008 | Palenske | 49/468 |
| 8,413,383 | B2 | 4/2013 | Van Camp et al. | 49/468 |
| 8,443,554 | B1 | 5/2013 | Teodorovich | 49/506 |
| 8,490,332 | B2 | 7/2013 | Van Camp et al. | 49/468 |
| 8,522,483 | B2 | 9/2013 | Van Camp et al. | |
| 8,567,128 | B2 | 10/2013 | Van Camp et al. | 49/468 |
| D701,323 | S * | 3/2014 | Fortun | E06B 1/70 D25/48.2 |
| 8,991,100 | B2 | 3/2015 | Van Camp et al. | |
| 8,991,101 | B2 | 3/2015 | Van Camp et al. | |
| 9,051,777 | B2 | 6/2015 | Van Camp et al. | |
| 9,371,682 | B2 | 6/2016 | Van Camp et al. | |
| 9,528,314 | B2 | 12/2016 | Mitchell et al. | |
| 9,624,716 | B2 | 4/2017 | Mitchell et al. | |
| 9,725,945 | B2 | 8/2017 | Swank et al. | |
| 9,874,054 | B2 | 1/2018 | Mitchell et al. | |
| 10,066,433 | B2 | 9/2018 | Van Camp et al. | |
| 10,202,795 | B2 | 2/2019 | Swank et al. | |
| 10,407,975 | B2 | 9/2019 | Van Camp et al. | |
| 10,697,228 | B2 | 6/2020 | Swank et al. | |
| 2002/0194788 | A1 * | 12/2002 | Bennett | E06B 1/70 49/467 |
| 2005/0198911 | A1 | 9/2005 | Baczuk et al. | 49/504 |
| 2006/0005470 | A1 * | 1/2006 | Mullen | E06B 1/70 49/467 |
| 2006/0096190 | A1 | 5/2006 | Baczuk et al. | 52/204.1 |
| 2006/0150521 | A1 | 7/2006 | Henry et al. | 49/471 |
| 2006/0174545 | A1 | 8/2006 | Young | 49/468 |
| 2008/0120914 | A1 * | 5/2008 | Fink | E06B 1/56 49/469 |
| 2008/0229669 | A1 * | 9/2008 | Abdollahzadeh | E06B 1/70 49/468 |
| 2009/0199486 | A1 | 8/2009 | Wernlund et al. | 49/471 |
| 2013/0199100 | A1 * | 8/2013 | Van Camp | E06B 1/70 49/468 |
| 2013/0276376 | A1 | 10/2013 | Gilbert et al. | 49/469 |
| 2015/0308180 | A1 * | 10/2015 | Meeks | E06B 7/2316 49/470 |
| 2016/0273260 | A1 | 9/2016 | Jolie et al. | 7/14 |
| 2017/0058592 | A1 * | 3/2017 | Meeks | E06B 7/2312 |
| 2017/0342764 | A1 * | 11/2017 | Headrick | E06B 7/2316 |
| 2018/0100345 | A1 * | 4/2018 | Meeks | E06B 1/70 |
| 2018/0274244 | A1 * | 9/2018 | Ortega | E06B 1/70 |
| 2019/0218849 | A1 * | 7/2019 | Bryant | E06B 1/70 |
| 2020/0024889 | A1 * | 1/2020 | Mitchell | E06B 7/18 |
| 2020/0048954 | A1 * | 2/2020 | Wang | E06B 1/342 |

FOREIGN PATENT DOCUMENTS

| | | | | |
|---|---|---|---|---|
| CA | 2851461 | A1 * | 11/2014 | E06B 1/70 |
| CA | 2928085 | A1 * | 11/2016 | F16J 15/022 |
| CA | 2928089 | A1 * | 11/2016 | E06B 7/2316 |
| EP | 0723063 | | 5/1995 | E06B 1/70 |
| EP | 0736660 | | 4/1996 | E06B 1/70 |
| EP | 0789128 | | 2/1997 | E06B 1/70 |
| EP | 0723061 | | 8/1998 | E06B 1/70 |
| EP | 1001127 | | 11/1999 | E06B 1/70 |
| EP | 0819816 | | 1/2001 | E06B 1/70 |
| EP | 1186740 | A1 * | 3/2002 | E06B 1/70 |
| EP | 1270861 | | 6/2002 | E06B 1/70 |
| EP | 1087090 | | 10/2002 | E06B 1/70 |
| EP | 1516991 | | 9/2004 | E06B 1/70 |
| GB | 2121465 | | 12/1983 | E06B 1/70 |
| GB | 2259933 | | 7/1991 | E06B 1/70 |

* cited by examiner

DOOR SILL SYSTEM, APPARATUS AND METHODS FOR A DOOR ASSEMBLY

This application claims the benefit of provisional application No. 62/729,725, filed Sep. 11, 2018, which is incorporated herein by reference in its entirety.

FIELD OF TECHNOLOGY

The present disclosure relates generally to doors and door assemblies having a door sill for entranceways, for example, for a building and, more particularly, to a door sill system, device, apparatus, and/or methods for a door sill assembly for a residence/facility.

BACKGROUND

A door sill takes constant and repeated traffic, weathering and abuse. Some parts of a door sill may age faster or slower than others and/or may be the focal point of more traffic flow. Important variables in door sill applications are a secure fit, durability and expense. In some attempts, door sills have been made one piece to be more durable. However, one piece door sills remain expensive, may still wear in certain areas more than others, may not provide a desirable fit over time, or become damaged in certain areas of the sill. If an owner wants to make the door sill more aesthetically pleasing when damage occurs, the one piece door sill requires full installation and repair, adding a new full unit, not a desirable option when door sills still have a cost barrier. Therefore, traditional sills are typically too expensive for aesthetic replacement of the entire unit due to damage to one portion of the sill, and a better fit, cost and option for replacement are still needed.

Thus, the Applicant recognized there remains a need for a cost effective, durable door sill that resists foot traffic, weathering and long-term exposure to moisture and, in some embodiments, allow replacement of a damaged part or replacement of the entire sill economically.

SUMMARY

The present disclosure is directed in one embodiment to a system, device, method and/or kit for a door sill assembly for a doorway.

In some embodiments, a door sill having a deck, may include a molded base component and a deck component fitting with the molded base component. A base component may include a base portion and a cap portion. The base portion and the cap portion may be integrally formed with one another in some examples. The cap portion may extend from the base portion.

The base portion may include a cap surface. The cap surface may extend along a top plane of the base portion for forming a seal with a door panel. The base portion may include a first end having a first wall and a second end having a second wall.

A deck support surface may extend along a second plane. The deck support surface may include recesses and a set of support platforms to form a discontinuous planar support.

The base portion may include a lip at the base portion second end that extends beyond the base portion second end wall. The lip may also include a terminating end.

The deck component may fit with the molded base component, for example, along a discontinuous planar support. The deck component may include a first end, a second end, a medial section between the first end and the second end, a deck top, and a deck bottom.

A top surface on the deck top may include a set of raised treads.

The deck component may include a projection located toward the first end. The projection may extend into one of the recesses.

In one example, a supported segment of the deck along the medial section may be supported by at least one of the support platforms. The at least one of the support platforms may be located in between one of the recesses.

Embodiments may include a lip cap toward the second end of the deck component. The lip cap may include a downwardly oriented segment that mates with a terminal end of the lip. A turn segment may mate with an underside of the lip. A lip cap may substantially cover the lip at the terminating end. The lip cap may secure the deck component with the molded base component by way of the lip cap and the projection, forming a securing tension.

In some embodiments, a door sill may include a sill extender cavity. The sill extender cavity may include a first connector feature. The sill extender cavity may include a second connector feature.

Some embodiments may include a terminating point separated apart from the second end wall by an opening. The opening may be defined on one side by the second end wall, on a top side by the turn segment, and on an opposite side by the second connector, with a space on a bottom side so that the second connector and the second end wall are spaced apart from one another.

A door sill according to examples of the present disclosure may include cap support ribs in the base portion. The door sill may, in other examples, include a caulking surface on the underside of the base portion. The caulking surface may be integral with the base portion.

In one example, a molded base component may be an injection molded base component.

In one example, the deck component may be an extruded aluminum deck component.

Embodiments may include a door sill where a deck component is removable from a molded base component. A second deck component may be configured to be replaceable with the deck component, such that the second deck component may mate with the molded base component.

The inventions of the present disclosure may be considered a method for a door sill for a doorway by way of any of the embodiments disclosed.

The inventions of the present disclosure may be considered a door sill having replaceable portions according to any of the embodiments disclosed herein. One of the replaceable portions may be a deck portion.

One example may include a kit for a door sill according to any of the embodiments disclosed herein. In one example of a kit, the kit may include a door sill having a deck component and a second deck component for replacing the deck component.

These and other aspects of the inventions of the present disclosure will become apparent to those skilled in the art after a reading of the following description of embodiments when considered with the drawings.

DESCRIPTION OF EMBODIMENTS

Figure 1:
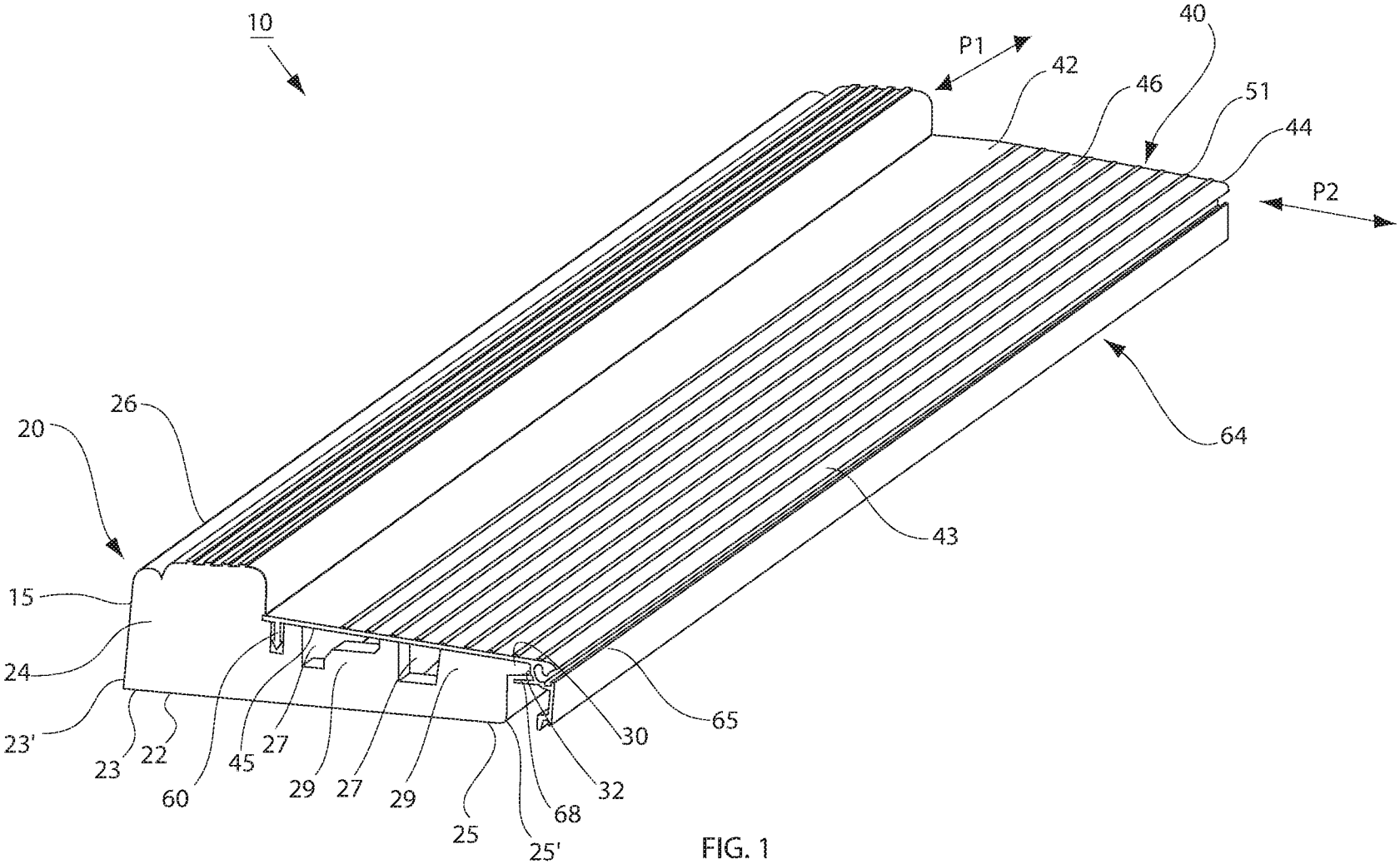
FIG. 1 is a side perspective view of one embodiment of a door sill assembly for a doorway constructed according to the present disclosure.

In the following description, like reference characters designate like or corresponding parts throughout the several views. Also in the following description, it is to be understood that such terms as "forward," "rearward," "left," "right," "upwardly," "downwardly," and the like are words of convenience and are not to be construed as limiting terms.

A door frame often includes one or more frame members. A plurality of frame members may include any combination of a header, a sill, mullion components, jamb components, and/or a trim profile. A header may be generally placed toward the top of a door assembly. Mullions and jambs components may be generally placed at opposing sides of a door assembly. Frame assemblies may also include hinges for connecting door panels to at least one of the frame members. The frame assembly may also include locking hardware that enables the door to be secured to as least one of the frame members and/or to another frame member. Locking hardware, by way of example, may include latches and deadbolts. Toward the bottom of a doorway typically is a door sill assembly.

Referring now to the drawings in general, it will be understood that the illustrations are for the purpose of describing a preferred embodiment of the inventions and are not intended to limit the inventions thereto. Shown throughout FIGS. 1-4, and referencing a door sill 10, in some embodiments, a door sill 10 may include a base component 20 and a deck component 40 for fitting with the base component 20. The base component 20 may be a molded base component.

A base component 20 may include a base portion 22 and a cap portion 24. The base portion 22 and the cap portion 24 may be integrally formed with one another in some examples. The cap portion 24 may extend from the base portion 22. The cap portion 24 may include a cap surface 26 and a back 15. The cap surface 26 may extend along a top plane P1 of the cap/base portion 22/24 for forming a seal with a door panel.

The base component 20 may include a first end 23 having a first wall 23' and a second end 25 having a second wall 25'. The base component may include one or more recesses 27 between the first end 23 and the second end 25. The base component 20 may include one or more support platforms 29. The support platforms 29 may be located between the first end 23 and the second end 25. In some examples, one or more of the support platforms 29 may form a discontinuous substantially planar support along plane P2.

In other embodiments, a supported segment of a deck component 40, along a medial section 46 of the deck component may be supported by at least one of the support platforms 29. The at least one of the support platforms 29 may be located in between one or two of the recesses 27.

The base portion 24 may include a lip 30 at the base portion second end 25. The lip 30 may extend beyond the base portion second end wall 25'. The lip 30 may also include a terminating end 32. The lip 30 may form a shelf toward the terminating end 32. The shelf may be an unsupported shelf or partially unsupported shelf in this embodiment, extending beyond second wall 25'.

A deck component 40 may fit with the base component 20. In some example, deck component 40 may fit with the base component 20 along a discontinuous planar support along P2. The deck component 40 may include, in some examples, a first end 42, a second end 44, a medial section 46 between the first end 42 and the second end 44, a deck top 43, and a deck bottom 45. A deck top surface on the deck top 43 may include a set of raised treads 51.

The deck component 40 may include a projection 60 located toward the first end 42. The projection 60 may extend into one of the recesses 27. The projection 60 may be configured to be secured in recess 27. The projection 60 may include a barb along one or more points of a projection length.

A deck surface may extend parallel to a second plane P2.

In some examples a door sill for a door assembly including support platforms may include a medial support 29C, a distal support 29D, and a proximal support 29B. The door sill for a door assembly may including a base support 29A. There may be a recess between the proximal support and the medial support. There may be a recess between the medial support and the distal support. A top portion of the base support 29A and a top portion of the proximal support 29B each may include a wedge-shaped corner for guiding entry of the projection into the jointly formed recess formed between the supports. The supports may be dispersed to provide a discontinuous support along variable points along the support surface in the plane P2 to minimize materials and cost while also maximizing sturdiness and support for the deck portion. An alternating arrangement of supports and recesses may provide such an arrangement.

Embodiments including a deck component 40, may include a lip cap 64 toward the second end 44 of the deck component. The lip cap 64 may partially surround lip 30. The lip cap 64 may include a downwardly oriented segment 65 that mates with a terminal end of the lip 32. A turn segment 68 may mate with an underside of the lip 30. A lip cap 64 may substantially cover the lip 30 at the terminating end 32. The lip cap 64 may secure the deck component 40 with the base component 20 by way of the lip cap 64 and a securing of the projection 60, forming a securing tension when both the lip cap 64 and projection 60 are fitted into place.

Figure 2:
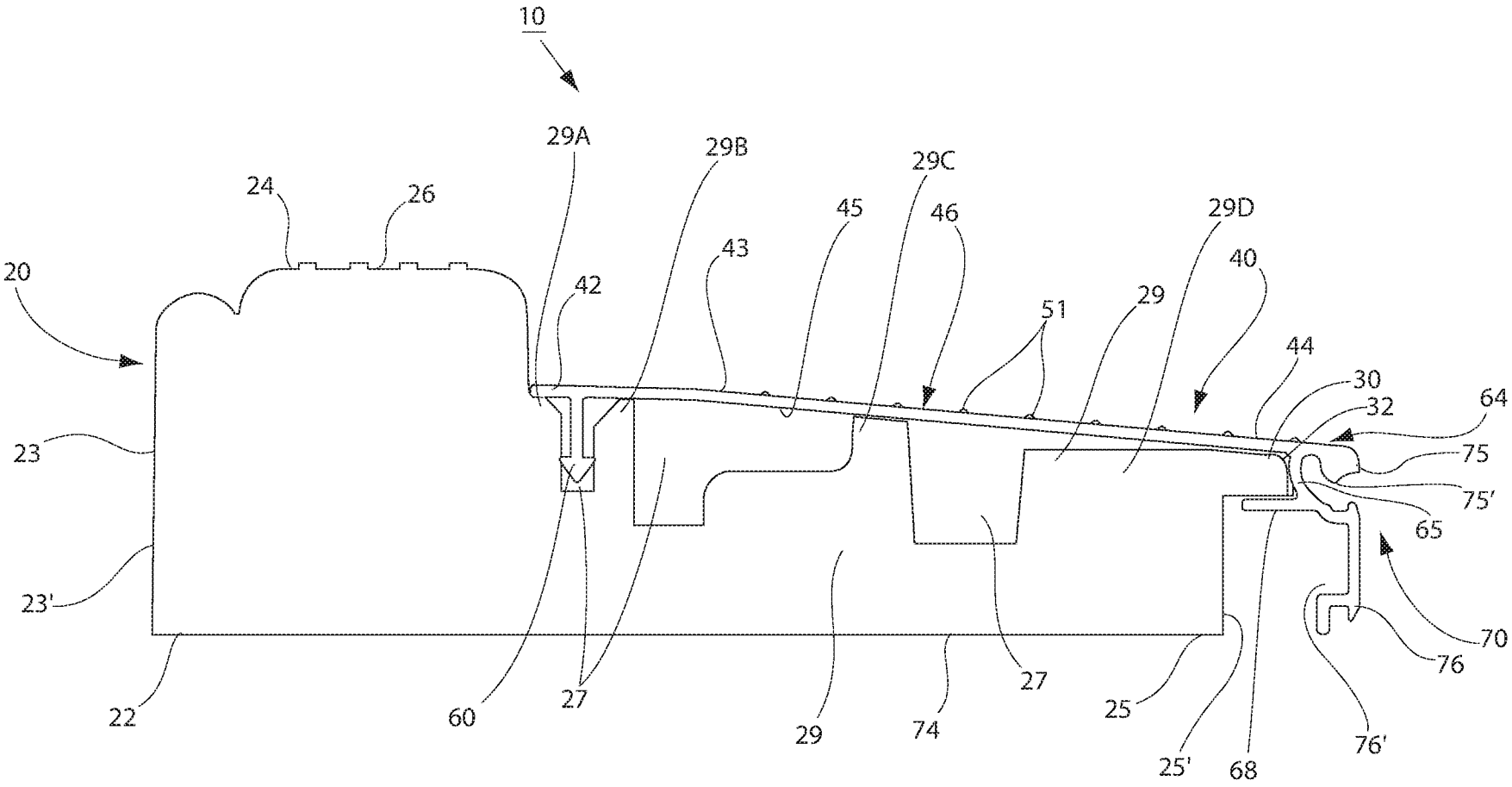
FIG. 2 is an end view of one embodiment of the door sill assembly of FIG. 1.
Figure 3:
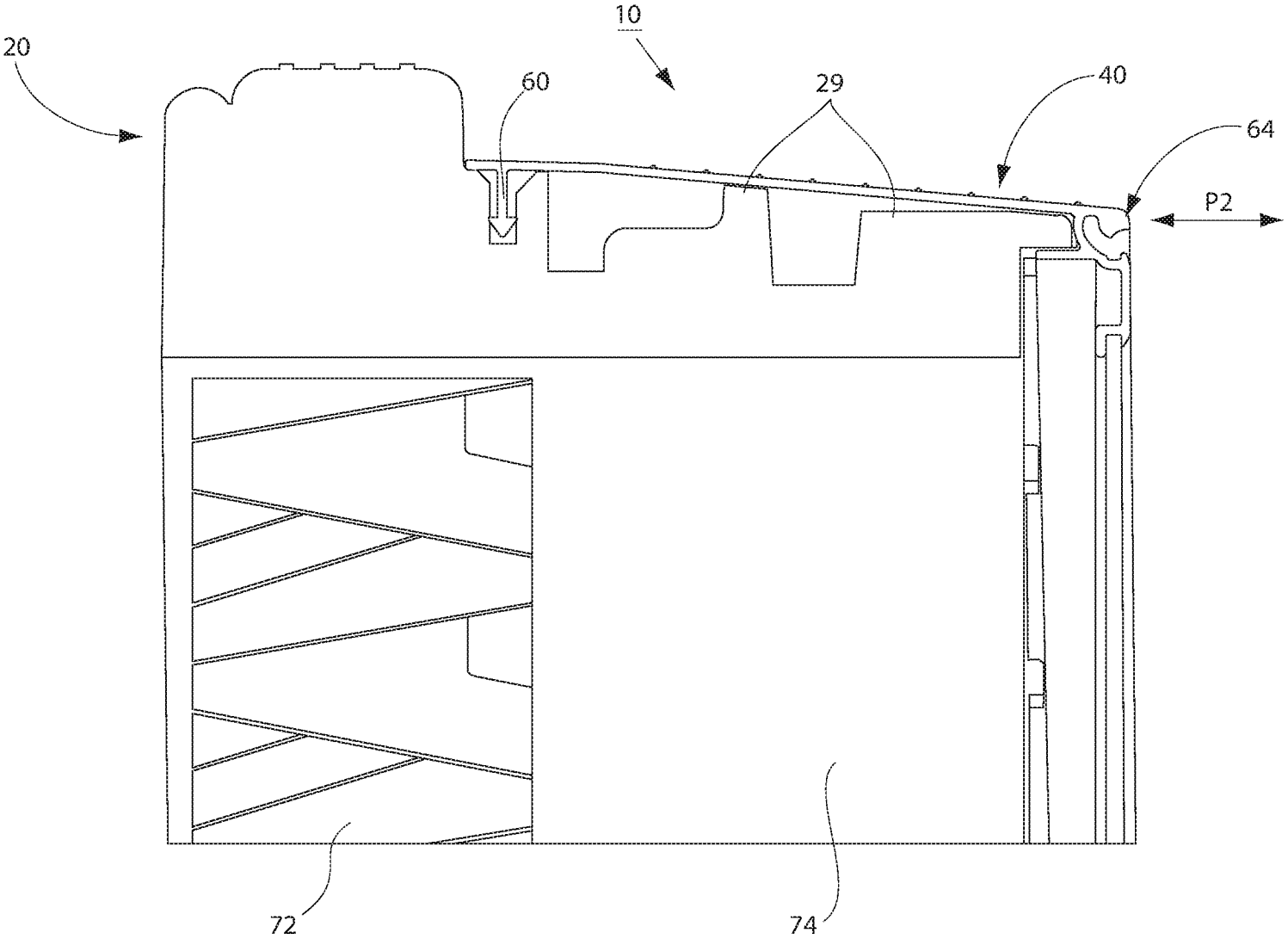
FIG. 3 is a perspective bottom view of one embodiment of the door sill assembly of FIG. 1.
Figure 4:
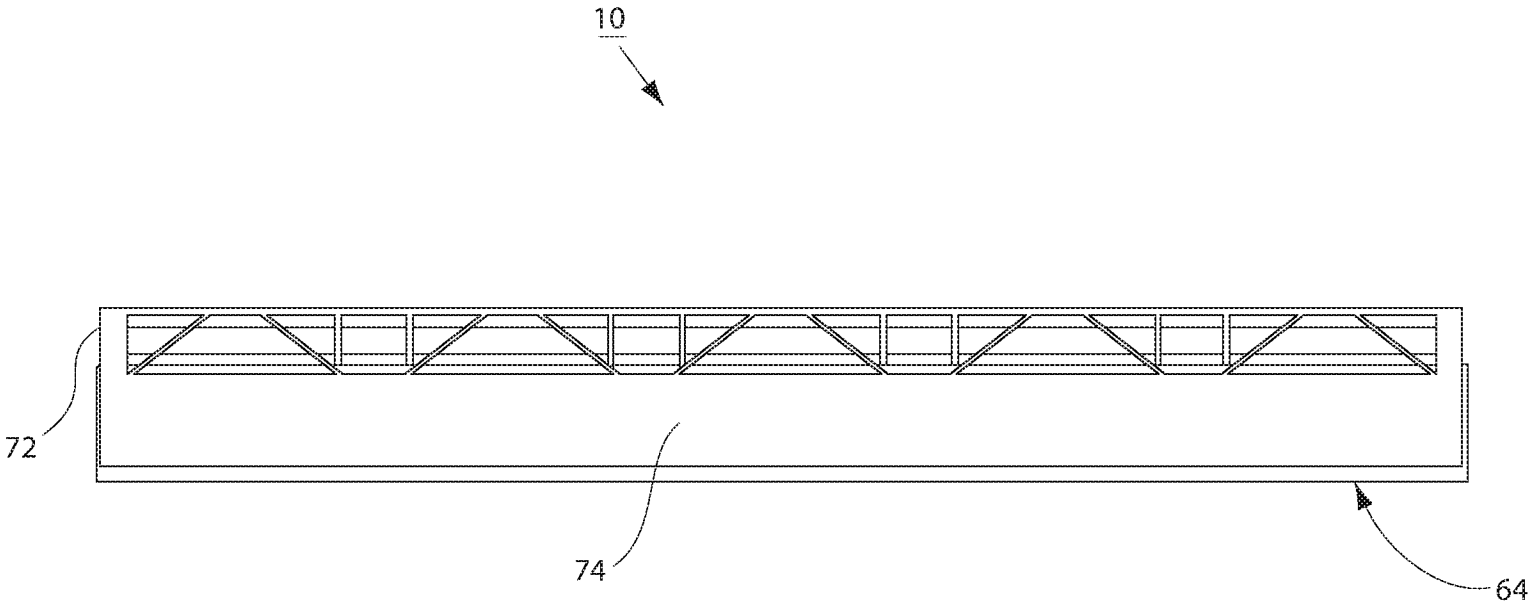
FIG. 4 is a bottom view of one embodiment of the door sill assembly of FIG. 1.

In some embodiments, a door sill 10 may include a sill extender 70 (location shown in FIG. 2). The sill extender 70 may lengthen the deck sill through connector to a first connector feature 75. The sill extender 70 may connect to a second connector feature 76. Sill extender 70 may extend in substantially the same plane P2 and provide a longer length to the door sill 10. Some embodiments may include an upper cavity 75' and a lower cavity 76', the upper cavity 75' and lower cavity 76' separated apart from one another by the downwardly oriented segment 65. The lower cavity 75' may be defined on one side by the second end wall 25', on a top side by the turn segment 68, and on an opposite side by the second connector feature 76, with an opening on a bottom side so that the second connector feature 76 and the end wall 25' are spaced apart from one another. The first connector feature 75 may include a curved surface and an opposite rounded surface forming the upper cavity 75'.

A door sill 10, according to examples of the present disclosure, may also include one or more support ribs 72. The door sill may, in other examples, include a caulking surface 74 on the underside of the base portion 24. The caulking surface 74 may be integral with the base portion 24.

In one example, a molded base component 20 may be an injection molded polymer base component.

In one example, the deck component 40 may be an extruded aluminum deck component. In an example including a molded polymer base component and an extruded aluminum deck component, structured according to any of the embodiments disclosed, the door sill 10 maintains a secure fit with a door panel, minimizes materials needed for construction of the sill, is durable and damage resistant and is cost effective, reducing production cost of the door sill 10.

Some examples may include where a cap surface 26 is a sealed surface. The cap surface 26 may be, in some embodiments a non-adjustable surface. The cap surface 26 may include integrally formed treads.

In other examples, the door sill 10 may be considered a one-piece fixed sill with an aluminum deck secured thereto. In other examples, the door sill 10 may be considered a two-piece door sill.

Some embodiments may include wherein a deck component 40 is removable from a base component 20, in some instances with base component 20 remaining installed. In some instances, deck component 40 may be interchangeable with a replacement deck component 40.

The inventions of the present disclosure may be considered a method for a door sill 10 for a doorway by way of any of the embodiments disclosed. The inventions also include a method for an economical door sill 10.

Certain modifications and improvements will occur to those skilled in the art upon a reading of the foregoing description. It should be understood that all such modifications and improvements have been deleted herein for the sake of conciseness and readability but are properly within the scope of the following claims.

We claim:

1. A door sill having a deck, comprising:

a molded base component, including:

a base portion and a cap portion, integrally formed with one another, the cap portion extending from the base portion, a cap surface along a top plane of the base portion, a deck support surface extending along a second plane, the deck support surface including recesses, and a set of support platforms to form a discontinuous planar support, a base portion first end having a first end wall, and a base portion second end having a second end wall, a lip at the base portion second end that extends beyond the base portion second end wall, the lip including a terminating end, a deck component fitting with the molded base component along the discontinuous planar support, including:

a first end, a second end, a medial section between the first end and the second end, a deck top, and a deck bottom, a top surface on the deck top, a projection located toward the first end, the projection extending into one of the recesses, a supported segment of the deck along the medial section that is supported by at least one of the support platforms, the at least one of the support platforms being located in between two of the recesses, and a lip cap at the second end, the lip cap including a downwardly oriented segment that mates with a terminal end of the lip, and a turn segment that mates with an underside of the lip, the deck first end supported by a base support extending from an inside wall of the cap portion of the base component, wherein the deck first end abuts the inside wall of the cap portion in an unobstructed manner, wherein said lip cap substantially covers the lip at the terminating end and secures the deck component with the molded base component by way of the lip cap and the projection forming a securing tension, and the door sill consisting of a two-piece door sill, wherein the deck component is adjoined to said molded base component, the base component extending along a bottom surface from the first end to the terminating end at the lip cap to provide support for the deck component through the support platforms that are spaced along an entirety of the length of the deck component.

2. The door sill of claim 1, including a sill extender cavity.

3. The door sill of claim 2, wherein said sill extender cavity includes a first connector feature and a second connector feature.

4. The door sill of claim 1, including support ribs in the base portion.

5. The door sill of claim 1, including a caulking surface on the underside of and integral with the base portion.

6. The door sill of claim 1 wherein said molded base component is an injection molded base component.

7. The door sill of claim 6 wherein said deck component is an extruded aluminum deck component.

8. The door sill of claim 7 wherein said deck component is adjoined to said molded base component, and mates with the molded base component to form a non-adjustable cap surface.

9. A door sill for a door assembly comprising:

a base component having a base portion and a cap portion, deck component extending from a front face of the cap portion to beyond a second wall of the base portion, a discontinuous deck support surface including:

a set of support platforms, a set of recesses, and a snap fit projection extending inwardly from the deck component and mating with one of the recesses, wherein said deck component secures to said base component by way of a tension formed by the snap fit projection inserting into the recess and a lip interfacing with a lip cap, and the door sill consisting of the base component having the cap portion extending above a deck surface, and the deck component fitting onto a top surface of the base portion and abutting an edge surface of the cap portion at a deck first end by way of a base support extending from an inside wall of the cap portion of the base component, a bottom of the base portion forming a planar surface extending the length of the base component.

10. The door sill for a door assembly of claim 9 including a downwardly oriented segment.

11. The door sill for a door assembly of claim 10 including a turn segment, wherein the downwardly oriented segment and the turn segment form a U-shaped hook around the lip.

12. The door sill for a door assembly of claim 11 wherein the lip cap includes a first connector feature.

13. The door sill for a door assembly of claim 12 wherein the lip cap includes a second connector feature.

14. The door sill for a door assembly of claim 13 including an upper cavity for fitting an extension piece.

15. The door sill for a door assembly of claim 14 including a lower cavity.

16. The door sill for a door assembly of claim 9 wherein said support platforms includes a medial support, a distal support and a proximal support.

17. The door sill for a door assembly of claim 16 including a base support.

18. The door sill for a door assembly of claim 17 including a recess between the proximal support and the medial support.

19. The door sill for a door assembly of claim 18 including a recess between the medial support and the distal support.

20. The door sill for a door assembly of claim 19 wherein a top portion of the base support and a top portion of the proximal support each include a wedge-shaped corner for guiding entry of the projection.

* * * * *